United States Patent [19]

Smith

[11] 4,095,345

[45] Jun. 20, 1978

[54] STRAIGHT EDGE ASSEMBLY

[76] Inventor: Harris L. Smith, 6109 Stratford Ct., Huntsville, Ala. 35806

[21] Appl. No.: 864,454

[22] Filed: Dec. 27, 1977

[51] Int. Cl.[2] ..... B43L 13/02
[52] U.S. Cl. ..... 33/80
[58] Field of Search ..... 35/26; 33/76, 80, 79, 33/81

[56] References Cited

U.S. PATENT DOCUMENTS

| | | | |
|---|---|---|---|
| 2,511,654 | 6/1950 | Spoor | 33/80 |
| 3,972,123 | 8/1976 | Parshall | 35/26 |

FOREIGN PATENT DOCUMENTS

| | | | |
|---|---|---|---|
| 10,310 of | 1889 | United Kingdom | 33/80 |
| 18,817 of | 1914 | United Kingdom | 33/80 |

*Primary Examiner*—Harry N. Haroian
*Attorney, Agent, or Firm*—C. A. Phillips

[57] ABSTRACT

A straight edge assembly for an artist's canvas having a slotted arm and a pair of slotted clamping assemblies coupled to opposite ends of the slotted arm. Each of the clamping assemblies is in turn adapted to clamp to oppositely positioned frame members of the canvas, whereby the slotted clamping assemblies adjustably clamp the arm to frame members to effect a desired clamped position for said arm on said canvas.

3 Claims, 2 Drawing Figures

STRAIGHT EDGE ASSEMBLY

BACKGROUND OF THE INVENTION

1. Field of the Invention

This invention relates to drawing aids, and particularly to a straight edge assembly for use with an artist's canvas.

2. General Description of the Prior Art

While a great deal of art work is done on canvases mounted on solid board, particularly indoor studio work, a substantial quantity of art work is done, particularly outside, wherein a canvas is supported on a simple rectangular frame, commonly referred to as a stretcher. It is to be appreciated that in the fixed locale indoor environment, the artist's tools need not be particularly portable, and thus it has been found in general there is a greater variety of drawing aids which are more adaptable for the studio locale than for field usage. A particular case in point is the adjustably mounted straight edge which enables one to draw a series of parallel straight lines. There are a variety of such devices which may be mounted on drafting boards, but the applicant is unaware of any such device which is mountable on a stretched canvas. These devices are positioned very close to the surface of the board, and thus are unsuitable for use with an artist's brush.

Accordingly, it is an object of this invention to provide such a device.

SUMMARY OF THE INVENTION

In accordance with this invention, an arm or rod having a straight edge is positioned a spaced distance from the surface of a canvas by virtue of longitudinal extending slots in opposite end regions, through which a connector extends. Each connector is adjustably secured in a slot in the front side of separate slotted blocks, which blocks are oppositely positioned along outer sides of a frame, or stretcher, or a stretched canvas. In turn, each of these blocks is clamped by a connector which connects between a back side of a block to a slotted L-shaped block which adjustably clamps a side mounted block to the frame.

DETAILED DESCRIPTION OF THE DRAWINGS

Figure 2:
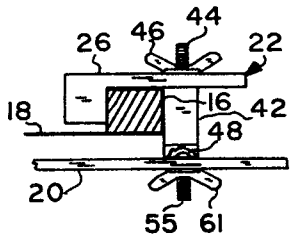
FIG. 2 is a partial plane view, partly in section, along lines 2—2 of FIG. 1.
Figure 3:
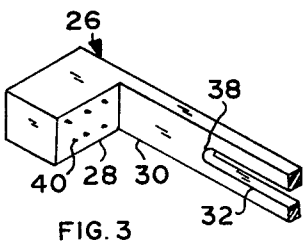
FIG. 3 is a pictorial view of one of the clamping blocks employed by the invention.
Figure 1:
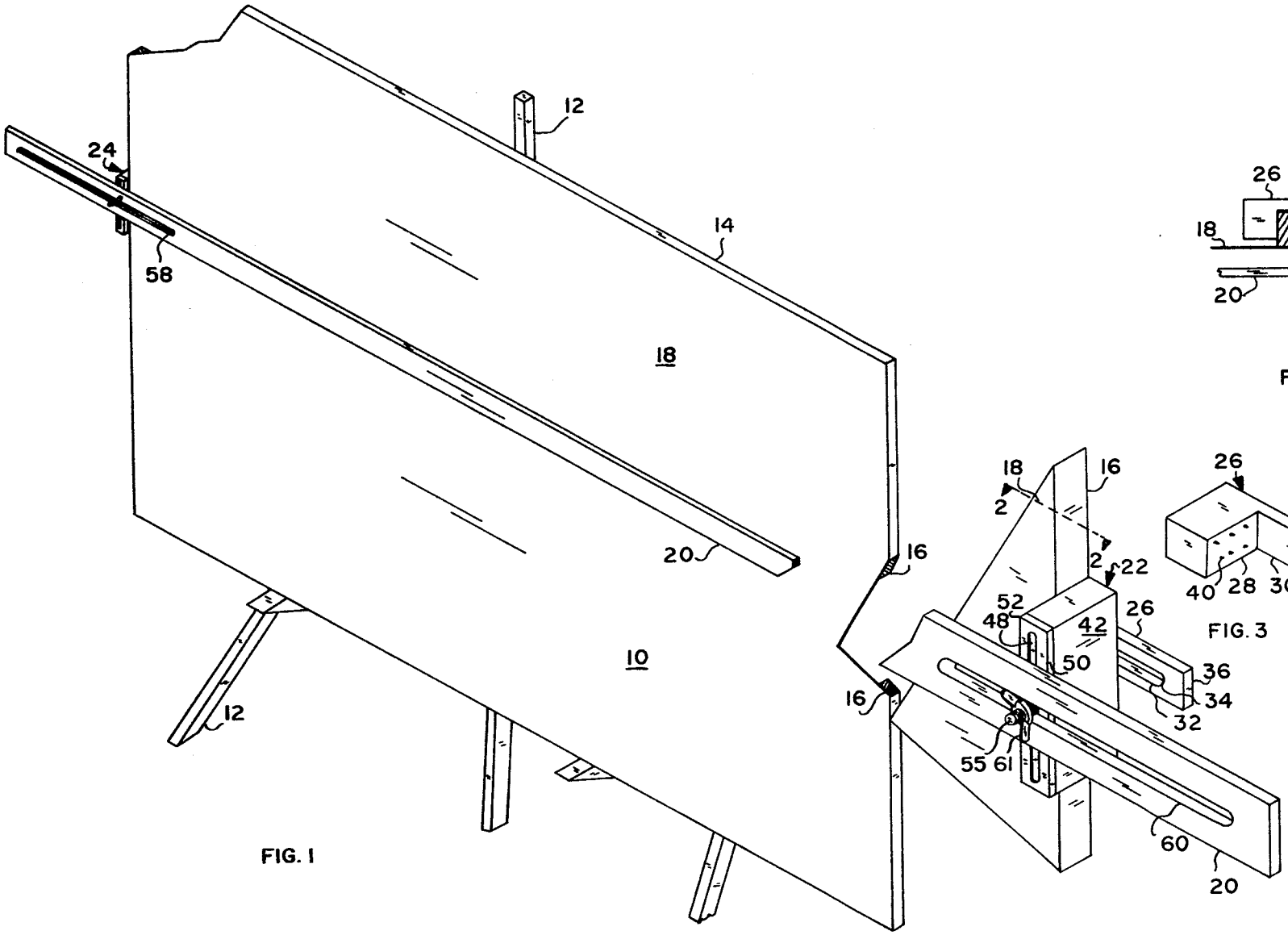
FIG. 1 is a pictorial view of an embodiment of the invention with a portion broken away and enlarged.

Referring to FIG. 1, a stretched canvas 10 is shown supported on a conventional, partially shown, easel 12. Stretched canvas 10 consists of a rectangular frame 14 of rectangular cross sectioned frame members 16 on which there is stretched and attached (by means not shown) a sheet of canvas 18 of a type employed by artists. Straight edge 20 is supported a fixed distance from the surface of canvas 18 by a pair of identical bracket assemblies 22 and 24, assembly 22 being shown in detail. A mounting block 26 of bracket assembly 22 is L-shaped and includes perpendicular joining surfaces 28 and 30 (FIG. 3) which engage rectangularly cross sectioned frame member 16. Mounting block 26 includes a longitudinal slot 32 which extends from a point 34 near end 36 to a point 38. Additionally, there are a plurality of pin-like protrusions 40 (FIG. 3) extending from joining surface 28 of block 26 to enable a more effective frictional engagement with frame member 16.

Side clamping block 42, which mates with mounting block 26, has a stud 44 firmly mounted in the rear of the block, and it extends through slot 32 of block 26, and the two are attachable by means of butterfly nut 46. Thus, in assembly, blocks 26 and 42 are pressed together, with frame member 16 between them, and butterfly nut 46 tightened. Side clamping block 42 extends forward of canvas 18 to include hollow region 48 which is closed, on a front side 50, by a plate 52 having a longitudinal slot 54. A bolt 55 is positioned with its head within hollow region 48 of block 42 and with its shank region extending out through slot 54, the bolt thus being locked from complete removal by virtue of slot 54 being of smaller width than the diameter of the head of bolt 55.

Straight edge 20 includes longitudinally extending slots 58 and 60 in its end regions, and thus as shown, bolts 55 extend through slots 58 and 60 and are lockable by means of butterfly nut 61.

In use, mounting blocks 26 of bracket assemblies 22 and 24 would be positioned on frame 14 where desired and locked in place by pressing side clamping blocks 42 against the outer side of frame member 16. Then tighten butterfly nut 46, thus firmly clamping bracket assemblies 22 and 24 to frame members 16 on opposite sides of frame 14. Then, straight edge 20 would be positioned with bolts 55 extending through slots 58 and 60, and then with straight edge 56 oriented as desired, nuts 61 would be tightened on bolts 55, and thus straight edge 20 would be locked in a desired position. This enables an artist to draw a straight line along straight edge 20 on canvas 18. If it is desired to draw a parallel or near-parallel line nearby, nuts 61 would be loosened and straight edge 20 appropriately shifted and then the nuts retightened. In the event that the desired shift would exceed the limits imposed by the combination of slots 58 and 60 in straight edge 20 and slot 54 in mounting block 42, then it would be necessary to shift one or both of bracket assemblies 2 and 24 to a new position by loosening butterfly nuts 46 as required, repositioning a bracket assembly or assemblies and then retightening the butterfly nuts.

From the foregoing, it is to be appreciated that the applicant has determined a straight edge device which does not require mounting to a solid board and which can be readily attached, removed and repositioned on a stretched canvas.

Having thus described my invention, what is claimed is:

1. A straight edge assembly for an artist's stretched canvas, a rectangular frame having rectangularly cross sectioned frame members supporting the back side of a sheet of canvas wherein each frame member has a discrete front-to-back thickness, and said assembly comprising:

an elongated flat surfaced rod having a straight edge and longitudinally extending openings in end regions of the rod normal to said straight edge;

first and second L-shaped blocks, each having perpendicular meeting inside surfaces which engage inside and back sides of a portion of said rectangularly cross sectioned frame, and having an end region which extends outwardly beyond the side of said frame; and first and second clamping blocks having a pair of planar opposite surfaces separated by a thickness dimension which is greater than said discrete front-to-back thickness of said frame member, and each including:

a slot in one of said surfaces of said clamping block and a connector held by an interior region of said clamping block and extending outwardly through and movable along said slot, position locking means for coupling said connector through said elongated opening in said rod and locking said clamping block to said rod, and means for adjustably clamping a said end region of said L-shaped block to said clamping blocks with said portion of frame member clamped between an L-shaped block and a said clamping block, whereby said rod is locked at a spaced distance in front of said stretched canvas and at selected positions which are adjustably movable by said position locking means.

2. A straight edge assembly for a stretched rectangular canvas as set forth in claim 1 whrein:

said connector is a threaded bolt having an enlarged head region;

said clamping block has an interior hollow region;

a plate having an elongated slot attached over said interior hollow region of said clamping block;

said bolt having its enlarged head region within said hollow region and restrained by said last-named elongated slot, and otherwise extending outward through said last-named elongated slot and through said slot in said rod; and a threaded nut adapted to thread on said bolt, whereby said rod is adjustably clamped to said stretched canvas.

3. A straight edge assembly for a stretched rectangular canvas as set forth in claim 2 wherein said means for adjustably clamping comprises:

a longitudinal slot in said end region of each said L-shaped block;

a bolt supported by each said clamping block and adapted to pass through said last-named longitudinal slot; and means for tightening said bolt and thereby tightening a said L-shaped block and a said clamping block together.

* * * * *